United States Patent [19]

Goedvolk

[11] 4,265,035

[45] May 5, 1981

[54] DRAG-HEAD FOR A SUCTION DREDGER WITH A PIVOTABLE SIGHT

[75] Inventor: Arie Goedvolk, Krimpen A/D Ijssel, Netherlands

[73] Assignee: Koninklijke Adriaan Volker Groep B.V., Rotterdam, Netherlands

[21] Appl. No.: 973,033

[22] Filed: Dec. 26, 1978

[30] Foreign Application Priority Data

Dec. 27, 1977 [NL] Netherlands ..... 7714438

[51] Int. Cl.[3] ..... E02F 3/92

[52] U.S. Cl. ..... 37/58

[58] Field of Search ..... 37/58, 61, 62, 63

[56] References Cited

U.S. PATENT DOCUMENTS

| | | | |
|---|---|---|---|
| 724,501 | 4/1903 | Reno | 37/58 |
| 1,840,606 | 1/1932 | Scheffauer | 37/58 |
| 3,975,842 | 8/1976 | Andreae | 37/58 |

FOREIGN PATENT DOCUMENTS

| | | | |
|---|---|---|---|
| 909831 | 1/1946 | France . | |
| 1249685 | 11/1960 | France . | |
| 58273 | 9/1946 | Netherlands . | |
| 101387 | 5/1962 | Netherlands . | |
| 107749 | 3/1964 | Netherlands . | |
| 6501314 | 8/1965 | Netherlands . | |
| 7000732 | 7/1971 | Netherlands . | |
| 7311208 | 2/1974 | Netherlands . | |
| 7510028 | 3/1977 | Netherlands . | |
| 397606 | 1/1974 | U.S.S.R. | 37/63 |

*Primary Examiner*—Clifford D. Crowder

[57] ABSTRACT

A drag head for a suction dredger having side blocks, which rest on unstirred soil, a pivotable sight, and a heel plate situated in front of the sight, the hinge for the sight being located at the lower edge of the sight.

3 Claims, 2 Drawing Figures

DRAG-HEAD FOR A SUCTION DREDGER WITH A PIVOTABLE SIGHT

The invention relates to a drag-head for a suction dredger, said drag-head being fitted with a sight which is pivotally articulated to the head around a cross-shaft and which has side edges running backward from a heal plate situated near the hinge and determining the suction slit by the back edge, and in which, near the back edge, a cutter is situated which protrudes obliquely forward and downwards from under the edges of the head, the top edge of said cutter forming a wide inlet opening with the inner wall of the sight. A similar drag-head is known. With this known drag-head problems will arise, particularly when one operates at a greater depths and a higher dragging power is available. Due to the restricted equilibrium forces on the drag-head, it appeared that the higher power could no longer be used effectively for cutting. Moreover, with the known drag-head, loss of vacuum over the drag-head will occur to such an extent that no sufficient suction force remains available to lift the soil cut loose at greater depths. And, finally, these restrictions of the equilibrium forces and of the suction force appear to affect each other unfavorably.

Thus, with more solid types of soil and at a greater suction depth, it may happen that the drag-head will float which can be prevented only by reducing the power of the ship's propellers which will not be favorable to production.

With lesser suction depths and, therefore, comparatively high frictional losses on the spot of the drag-head, production likewise appears to become low.

With more solid types of soil and average suction depths, the problem arises that the sight will tilt away from the bottom to the right (FIG. 1) while, with softer types of soil, the sight will tilt in exactly the opposite direction, as a result of which the cutters will penetrate too far into the soil and the drag-head may become clogged.

With clay types of soil, the problem arises that a fairly considerable part of the dragging power is used ineffectively to overcome the high adhesive friction over the large heel plate surface.

The invention aims at providing a drag-head devoid of the aforesaid disadvantages.

According to the invention, this is achieved by mounting the heel plate as far as possible forward of the pivot and, at the same time, by providing a point of support as far as possible behind the pivot with the aid of slide blocks resting upon the original bottom beside the dredging slit. In this manner, supports are realized which, with a slight normal force between drag-head and bottom, can provide a high stabilizing moment in order to prevent the sight from tilting in any direction. The tilting moment resulting from cutting force is further minimized by placing the pivot of the sight as close as possible to the lower edge of the sight.

The sight behind the inlet opening is fitted with a plate directed backward, which plate is placed between partitions arranged in line with the side edges and is adjustable around a cross-shaft near its front edge, said plate having a flowingly curved shape with a rounded-off inlet edge for the purpose of adaptation to the flow.

By means of the backwards directed plate, the flow passing below it will exert a downward compressing force upon the sight, it being possible to regulate the height of the inlet slit by the adjustability of the plate, as a result of which, also due to the presence of the slide blocks, the in-flow rate via said slit and, consequently, the compressing force may be controlled. Owing to said plate having a flowingly curved shape, the vacuum losses during the in-flow will be reduced. Therefore, the plate causes a stable position and reduces the resistance to the inflowing water.

Alternatively, the stability of the sight may also be ensured by securing the sight, adjustably with respect to the suction pipe. With respect to a loose sight, however, this will have the disadvantage that unevenness of the bottom is more difficult to follow.

The known prior art sight has a profile of flow developing into the circular smaller cross section of the suction pipe from a narrow inlet slit via an intermediate large cross section, the latter being rectangular like that of the inlet slit. This inequality of the cross section implies a sharp fluctuation in the flow rate which is unfavorable. In fact, the invention proposes to profile the sight in such a manner that, from the inlet slit under the plate via the wide inlet opening up to and including the inlet of the suction pipe, the cross sections of the flow will be essentially alike. The flow rate will then also remain essentially alike.

According to the invention, it is preferable that the depth of penetration of the cutter be made adjustable so as to ensure an optimal drag rate.

Both heel plate and slide blocks are of a circular execution. In this manner, a minimal frictional surface, and therefore, a minimal adhesive frictional surface is achieved for all clay types of soil.

The invention will now be further illustrated with the aid of the drawings.

Figure 1:
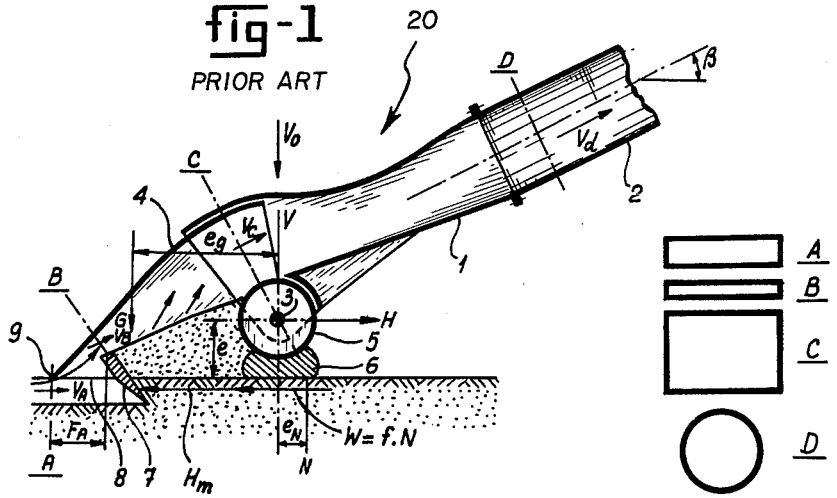
fig-1 PRIOR ART
FIG. 1 shows a diagram of the known drag-head with the forces, moments and flows occurring therein.

The prior art drag-head 20 as shown in FIG. 1 consists of the head 1, which is secured to the lower end of the suction pipe 2. At 3, said head has a hinge to which the sight 4 is secured which is sealed by a cylindrical member 5 with respect to the head 1, and an arcuated top part of sight 4 extends into an analogously shaped bottom end of the head 1. Under the cylindrical member 5 the heel plate 6, resting upon the bottom, is situated.

At 7, the sight is fitted with a transversely extending cutter which protrudes from under the side edges 8 and the back edge 9 of the sight.

The various cross sections of sight, drag-head and suction pipe are marked with A,B,C and D. Also, the angle of inclination $\beta$ as well as the various active forces are shown, namely:

$V_o$=net weight of the suction pipe less the force on the suction mouth hoisting wire, i.e. the cable with which the suction pipe is suspended from the ship;

V=the resulting vertical force in the hinge 3;

H=the net horizontal tractive force raised by the ship's propellers;

N=the normal force of the sight upon the bottom;

W=the frictional force between sight and bottom; this force is mostly proportional to the normal force N, according to $W=f \cdot N$;

Hm=the cutting force as required by the soil.

G=the resultant of the sight weight $G_1$, and the vacuum force between sight and bottom occurring due to the flow ($G=G_1+G_2$);

Additionally, this drawing indicates the flow rates through sections A,B,C and D as $V_A, V_B, V_C$ and $V_D$. Finally, the drawing shows the arms e, $e_g$, $e_N$ between the forces and the hinge 3.

It will be clear that $V = V_o - H$ tangent $\beta$ (1.1).

Therefore, the resulting vertical force V on the sight hinge is dependent on the angle of inclination and will decrease as the angle increases.

For a well-balanced sight the following should be complied with:

a. Vertical equilibrium: $N = V + G = V_o + G - H$ tangent $\beta > 0$ (1.2). b. Horizontal equilibrium: $H - W > Hm$ (1.3). c. The moment equilibrium around the hinge 3: $G.e_g + N.e_N > (Hm + W)$ e.(1.4)

From the equation (1.2) it follows that, when $N < O$, the drag-head will float and the cutters will lose contact with the soil.

From the equation (1.3) it follows that, when $H - W < Hm$, the cutter 7 will not be able to break the cohesion of the soil.

From the equation (1.4) it follows that, when this condition is not fulfilled, the heel plate 6 will indeed remain rested upon the bottom but that the sight in FIG. 1 will tilt to the right, as a result of which the cutter 7 will lose contact with the soil.

For a better notion of the invention, a further elucidation of the problems with the drag-head follows.

When comparatively solid types of soil are concerned, the cutter will provide a high resistance which means that Hm is high and, consequently, the tractive force H to be provided by the ship's propellers must likewise be high. Now, in the case of great depth, the angle $\beta$ will be great and, when the equation (1.2) is observed, it will be clear that the normal force N of the sight 4 upon the bottom may become smaller than 0 or equal to 0, as a result of which the drag-head will float. This may be prevented by reducing the tractive force of the vessel, i.e. by reducing H, but this will then be at the cost of production. If the normal force is increased by using a heavier drag-head, then the frictional force is considerably increased at a small suction depth and energy is wasted. Moreover, winches and derricks of the suction dredges would then have to be made heavier. When the suction depth is small, the angle $\beta$ will likewise be small. According to the equation (1.2), this will then result in an increase of the normal force N and, consequently, of the frictional loss $W = fN$. According to the equation (1.3), this will result in a decrease of $H - W$, so that little is left over for the cutting force Hm. This, too, will evidently be at the cost of production.

If comparatively solid types of soil are concerned with an average suction depth, the sight appears to have the tendency to tilt to the right in FIG. 1, i.e. from the bottom, even at a sufficiently high normal force, under the influence of the moment exerted by the cutting force Hm times the distance e to the hinge 3 of the sight.

This may be overcome by reducing the tractive force H and, therefore also the cutting force, which will then be at the cost of production.

This may also be overcome by securing the sight with respect to the head 1. However, no good connection to an irregular profile of the bottom is then realized, and this will likewise be at the cost of production.

When soft types of soil are concerned, such as clay or the like, the sight will tilt exactly in the opposite direction. The sight weight $G_1$ and the vacuum forces $G_2$ acting upon the sight provide a moment contrary to that of the then small cutting force Hm. However, when the drag-head penetrates too far into the bottom, too much soil with too little water is supplied, due to which production is suspended and heavy vacuum shocks may occur in the system.

In explanation of the vacuum losses, it may be pointed out in the first place that, at the sections A,B,C and D, the cross section of the usual drag-head has the shapes as indicated on the right side of FIG. 1. Evidently, the respective cross-sections should be matched by a flow rate which will be high at the sections A and B but which, however, will slightly increase from A to B, after which it will slacken from B to C and should again accelerate from C to D. As a result of said slackening, vacuum losses will occur, which losses could be defined as retardation losses with the formula $\Delta H$ retardation $= X \cdot (V_A - V_C)^2$; equation (2.1). Here, X is a factor unimportant to the present disclosure.

Furthermore, the inlet losses occur at the inlet slit at the back edge 9 (cross section A). Here, the water flow is accelerated from a standstill to the rates of $V_A$ and $V_B$. This will result in vacuum losses originating from narrowing and eddying of the flow back edge 9. Said inlet losses may be indicated as $\Delta H$ inlet $= Y \cdot V_A^2$; equation (2.2). Here, Y is a factor in which the shape of the inlet opening plays a part.

With greater suction depths, it will be clear that more vacuum will be required to lift the mixture of the sea bottom under the influence of the sucking effect of the dredge pump. Said dredge pump has but a limited sucking power. Now, when the total of the vacuum loss over the drag-head (i.e. the retardation losses and inlet losses) is too high, then, with increasing suction depth, the sucking capacity of the dredge pump will be exceeded at the cost of production will, produce cavitation and may even lead to complete shallowing of the suction pipe.

Moreover, the force equilibrium described before which, therefore, can be upset by various factors, and the vacuum losses likewise described before will affect each other to the effect that the inlet rate $V_A$ will raise the vacuum force $G_2$ under the back edge of the sight 4 and over the range of the surface $F_A$, which vacuum force may be expressed in the formula $G_2 = Z \cdot V_A^{2 \cdot F_A}$; equation (2.3). Here again, Z is a factor not further defined.

Via the equations (2.3) and (1.2), the inlet rate $V_A$ will affect the force equilibrium; whereas via the equations (2.1) and (2.2), that same inlet rate will affect the vacuum loss over the drag-head.

Therefore, the force equilibrium is dependent on the vacuum loss over the drag-head.

Figure 2:
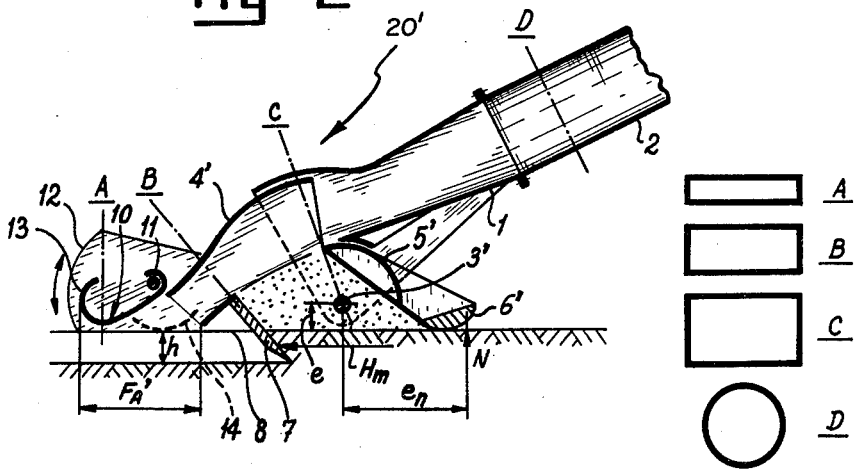
FIG. 2 shows the drag-head according to the invention.

In FIG. 2, the drag-head 20' according to the invention is shown in the same manner as in FIG. 1, consisting of a fixed head 1 secured to a suction pipe 2, a sight 4' with a cutter 7 rotatable around the hinge 3' and a heel plate 6'.

As appears from FIG. 2, the heel plate 6' has been moved forward over a distance $e_n$ with respect to the hinge 3' so that the normal force N acts over the distance $e_n$ and exerts a much greater moment to the left.

Also, the hinge 3' has been placed as low as possible so that, over a much smaller arm e, the cutting force Hm can exert a countermoment to the right with respect to the hinge 3'.

The back edge of the sight if fitted with a plate 10 rotatably secured around a horizontal cross-shaft 11 and situated between the side partitions 12 arranged more or less in line with the side edges 8 of the lower edge of the sight. As shown in the drawing, said plate 10 is curved in such a manner that a flowingly proceeding inlet edge 13 is realized.

The plate 10 is adjustable around the shaft 11 and, with it, the inlet slit on the spot of the section A.

The sight has slide blocks 14 on either side which rest upon the original bottom beside the dredging slit.

Due to the changed position of the heel plate 6', the sight hinge 3' and the slide blocks 14, the tendency to tilt to the right or to the left is suppressed.

Due to the rounded-off contour of plate 10, the inlet losses according to the equation (2.2) wll be smaller. This plate 10 has a larger surface $F_A'$ so that, according to the equation (2.3), a high vacuum force $G_2$ may be realized. This vacuum force $G_2$ is adjustable due to the adjustability of the plate 10, for the latter will then determine the in-flow section at A, the vacuum force being directly dependent on the inlet flow rate $V_A$.

Besides, with a changing cutter depth h (due to adjustable length of the cutter), the adjustability of the plate 10 will enable the vacuum force to remain optimal. The inlet slit and the cutting depth are now adjustable, as a result of which the moment to be exerted by the cutting force Hm acquires a countermoment, not only from the normal force owing to the heel plate 6' having been moved forward, but also from the vacuum force $G_2$.

Regulation of the vacuum force $G_2$ means regulation of G so that, according to equation (1.2), the normal force N may be optimal. This then implies that there is no longer the risk that the drag-head will float nor that the frictional force will be too high.

In other words, it will now be possible to render the action of the drag-head more independent on the angle of inclination $\beta$.

Furthermore, as appears from FIG. 2, the sections C and D are more closely alike; while the section B is enlarged as much as possible, and the section A can be variably adjusted. In this manner, the retardation loss according to the equation (2.1) can be minimal.

Therefore, with the drag-head according to the invention, retardation loss and inlet loss and, consequently, the vacuum loss are minimal so that less problems will arise when operating at greater depths.

I claim:

1. A drag-head for a suction dredger comprising a sight freely pivotable about a transversely extending axis during operation, said axis disposed proximate to the surface to be cut and located between a transversely extending blade and a heel plate, said cutting blade protruding downwardly and forwardly from below the lower edge of said sight, the top edge of said cutting blade forming an inlet opening with the inner wall of said sight, said heel plate connected to said sight and located in front of said axis for supporting said drag-head, said heel plate being at substantially the same level as said axis but spaced apart therefrom and contacting the surface to be cut at a point well forward of said axis thereby inhibiting forward tilting of said sight, and slide blocks attached to said sight spaced behind said axis and located outside of the side edges of said sight for resting upon an uncut surface thereby inhibiting rearward tilting of said sight.

2. The drag-head of claim 1 in which said sight behind said inlet opening is provided with a transversely extending plate directed rearwardly, said plate being mounted between side plates, which are in line with the side edges of said sight, said plate being adjustable about a tranverse axis near its front edge, said plate, having a curved cross-sectional shape defining a smooth curved inlet opening for said sight.

3. The drag-head of claim 2 in which the sight is shaped such that there is a flow passage from an inlet slit below said curved plate, through said inlet opening, through an upper portion of said drag-head and up to an inlet of a suction tube for said drag-head, the cross-sectional areas of the upper portion of said drag-head and said suction tube being approximately the same, the cross-sectional area of said inlet opening being slightly smaller than that of said upper portion of said drag-head and the cross-sectional area of said inlet slit being adjustably enlargable so as to approximate the cross-sectional area of said inlet opening.

* * * * *

UNITED STATES PATENT AND TRADEMARK OFFICE

CERTIFICATE OF CORRECTION

PATENT NO. : 4,265,035

DATED : May 5, 1981

INVENTOR(S) : Arie Goedvolk

It is certified that error appears in the above-identified patent and that said Letters Patent are hereby corrected as shown below:

Col. 1, line 12, "downwards" should be --downward--;

Col. 2, line 23, "sections" should be --section--;

Col. 4, line 44, in the formula, "$G_2=Z\cdot V_A^{2\cdot F_A}$" should be --$G_2=Z\cdot V_A^2.F_A$--;

Col. 4, line 56, "4'" should be --4--.

Signed and Sealed this

Sixth Day of October 1981

[SEAL]

Attest:

GERALD J. MOSSINGHOFF

Attesting Officer

Commissioner of Patents and Trademarks